US010321781B2

(12) United States Patent
Hendricks

(10) Patent No.: US 10,321,781 B2
(45) Date of Patent: Jun. 18, 2019

(54) DECORATIVE TREE STAND AND ASSOCIATED SYSTEMS AND METHODS

(71) Applicant: Shining Sea Trading Company, West Valley City, UT (US)

(72) Inventor: Jared Hendricks, Draper, UT (US)

(73) Assignee: SHINING SEA TRADING COMPANY, West Valley City, UT (US)

( * ) Notice: Subject to any disclaimer, the term of this patent is extended or adjusted under 35 U.S.C. 154(b) by 189 days.

(21) Appl. No.: 14/919,689

(22) Filed: Oct. 21, 2015

(65) Prior Publication Data

US 2016/0113427 A1 Apr. 28, 2016

Related U.S. Application Data

(60) Provisional application No. 62/066,756, filed on Oct. 21, 2014.

(51) Int. Cl.
*A47G 33/00* (2006.01)
*A47G 33/12* (2006.01)

(52) U.S. Cl.
CPC ..... *A47G 33/12* (2013.01); *A47G 2033/1266* (2013.01); *A47G 2033/1273* (2013.01)

(58) Field of Classification Search
CPC ..... A47G 33/04; A47G 33/06; A47G 33/12; A47G 33/1226; A01G 9/12
USPC ..... 47/40.5
See application file for complete search history.

(56) References Cited

U.S. PATENT DOCUMENTS 2,605,067 A * 7/1952 Lindsell ..... A47G 33/12 248/176.1
3,661,349 A * 5/1972 De Vries ..... A47G 33/1213 248/179.1
3,715,095 A * 2/1973 Drablowaski ..... A47G 33/12 248/515
4,847,123 A * 7/1989 Armstead ..... A47G 33/06 211/197
4,913,395 A * 4/1990 Juhas ..... A47G 33/1226 248/516
5,301,462 A * 4/1994 Hronyetz ..... A47G 33/1226 248/521
5,393,031 A * 2/1995 Leve ..... A47G 33/1226 248/516
5,398,444 A * 3/1995 Murray ..... A47G 33/1226 248/515
5,655,623 A * 8/1997 Skyba ..... E06C 1/381 182/100
5,938,168 A * 8/1999 Adams ..... A47G 33/12 248/523
6,019,341 A * 2/2000 Brown ..... A47G 33/1213 248/516
D497,832 S * 11/2004 Glover ..... D11/130.1
D498,172 S * 11/2004 Verni ..... D11/130.1
6,827,321 B1 * 12/2004 Murren ..... A47G 33/12 248/519

(Continued)

*Primary Examiner* — Monica L Williams
*Assistant Examiner* — Aaron M Rodziwicz
(74) *Attorney, Agent, or Firm* — Thorpe North and Western, LLP; Todd B. Alder

(57) ABSTRACT

A decorative tree stand that can include a support base and a tree support pivotally coupled to an upwardly facing surface of the support base is disclosed and described. The tree support can selectively pivot to allow the decorative tree to move from a display position to a storage position.

20 Claims, 7 Drawing Sheets

(56) References Cited

U.S. PATENT DOCUMENTS

| | | | | |
|---|---|---|---|---|
| 9,215,945 | B2 * | 12/2015 | PeCoy | A47G 33/04 |
| 2002/0093835 | A1 * | 7/2002 | Puleo, Sr. | A47G 33/12<br>362/568 |
| 2004/0026594 | A1 * | 2/2004 | Lee | A47G 33/12<br>248/523 |
| 2004/0262183 | A1 * | 12/2004 | Gildart | A45C 11/00<br>206/423 |
| 2005/0183975 | A1 * | 8/2005 | Stein | A47G 33/045<br>206/423 |
| 2005/0257422 | A1 * | 11/2005 | Hronyetz | A47G 33/1226<br>47/40.5 |
| 2006/0255230 | A1 * | 11/2006 | Bornemeier | A47G 33/045<br>248/519 |
| 2008/0191116 | A1 * | 8/2008 | Bornemeier | F16M 11/42<br>248/523 |
| 2013/0140421 | A1 * | 6/2013 | Hammond | A47G 33/1226<br>248/523 |

* cited by examiner

DECORATIVE TREE STAND AND ASSOCIATED SYSTEMS AND METHODS

PRIORITY INFORMATION

This application claims the benefit of U.S. Provisional Patent Application No. 62/066,756, filed on Oct. 21, 2014, which is incorporated herein by reference in its entirety.

BACKGROUND

Natural and artificial decorative trees are used in a variety of situations, including parties, weddings, holidays, as well as in routine business and home decor. When using decorative trees, tree stands are often used to provide support to such decorative trees, as well as to facilitate movement, placement, and storage in a variety of circumstances and/or locations.

BRIEF DESCRIPTION OF THE DRAWINGS

These drawings are provided to illustrate various aspects of the invention and are not intended to be limiting of the scope in terms of dimensions, materials, configurations, arrangements or proportions unless otherwise limited by the claims.

DESCRIPTION OF EMBODIMENTS

Figure 1A:
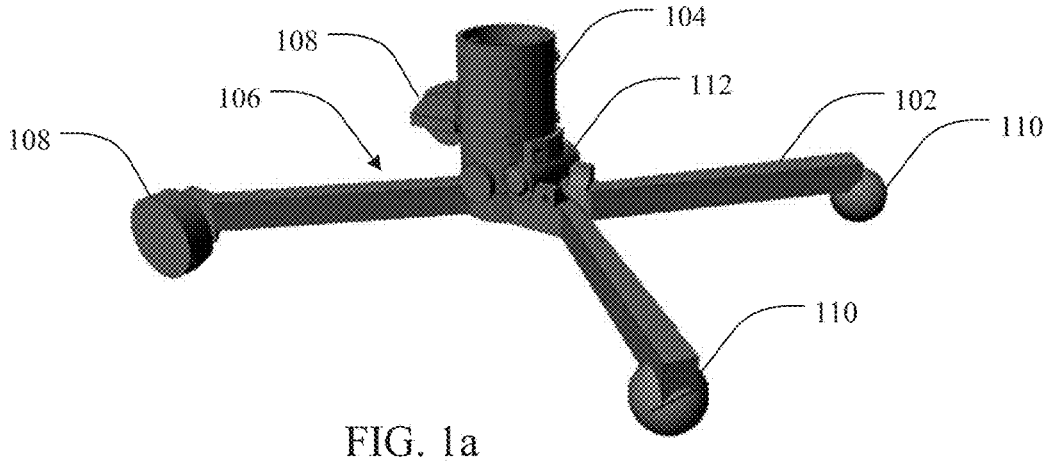
FIG. 1*a* is a perspective view of a device according to one aspect of the present disclosure.

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

"The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, "coupled" refers to a relationship of physical connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item where the items have at least one point of direct physical contact or otherwise touch one another. For example, when one layer of material is deposited on or against another layer of material, the layers can be said to be directly coupled.

As used herein, "adjacent" refers to the proximity of two structures or elements. In one example, elements that are identified as being "adjacent" may be either abutting or connected. In another example, such elements may also be near or close to each other without necessarily contacting each other. The exact degree of proximity may in some cases depend on the specific context.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. However, it is to be understood that even when the term "about" is used in the present specification in connection with a specific numerical value, that support for the exact numerical value recited apart from the "about" terminology is also provided.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 1.5, 2, 2.3, 3, 3.8, 4, 4.6, 5, and 5.1 individually.

This same principle applies to ranges reciting only one numerical value as a minimum or a maximum. Furthermore, such an interpretation should apply regardless of the breadth of the range or the characteristics being described.

As used herein, numerical values as applied to the content of a material in a composition of materials, including numerical values relative to one another, such as ratios, can be considered to be measured in atomic % (i.e. at %).

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

An initial overview of technology embodiments is provided below and specific technology embodiments are then described in further detail. This initial summary is intended to aid readers in understanding the technology more quickly, but is not intended to identify key or essential technological features, nor is it intended to limit the scope of the claimed subject matter.

Description of Example Embodiments

Decorative trees, both artificial and natural, are commonly used in business and home decor, weddings, parties, holiday events, and many other settings. In some cases, decorative trees can be frequently relocated, which may include moving them in and out of doorways, around obstacles, loaded into vehicles or trailers, stored in compact spaces, or handled in a variety of other ways. Such relocation and handling can be challenging, and can increase wear and tear on the trees.

The inventor has discovered that many of the challenges and the premature degradation of a decorative tree can be reduced through the use of a pivoting tree stand that, in some aspects, includes wheels or castors. Maintaining a decorative tree in the same stand for both display and storage purposes can greatly reduce both the difficulties in handling and the wear and tear on the tree. It is noted that designs capable of both display and efficient storage of a decorative tree can vary depending on a variety of factors, including, for example, design choice, the size of the decorative tree, the desired storage conditions, and the like. As such, the present scope includes any tree stand design capable of displaying a decorative tree and pivoting the tree into a storage position when not in use.

In one aspect, such a tree stand can display a decorative tree in a display position, such as, for example, a vertical or near-vertical position. For the present purposes, the term "vertical" is intended to be relative to a horizontal support surface, such as a floor. While the decorative tree can be displayed at a precisely vertical position, such is not required, and the present scope includes reasonable approximations of vertical as would be understood in the art. Additionally, the tree stand can be moved to one or more non-vertical positions to facilitated movement and/or storage of the decorative tree while still coupled to the tree stand. Such a non-vertical position allows the tree stand with the attached decorative tree to be moved through doorways, below light fixtures, and through and into areas that would not be accessible with the decorative tree in the vertical position. It is noted that "non-vertical" can include any position that a decorative tree can be tipped to that facilitates movement and/or storage, and that excludes "vertical" positions. Further description of non-vertical positions is described below.

Figure 1B:
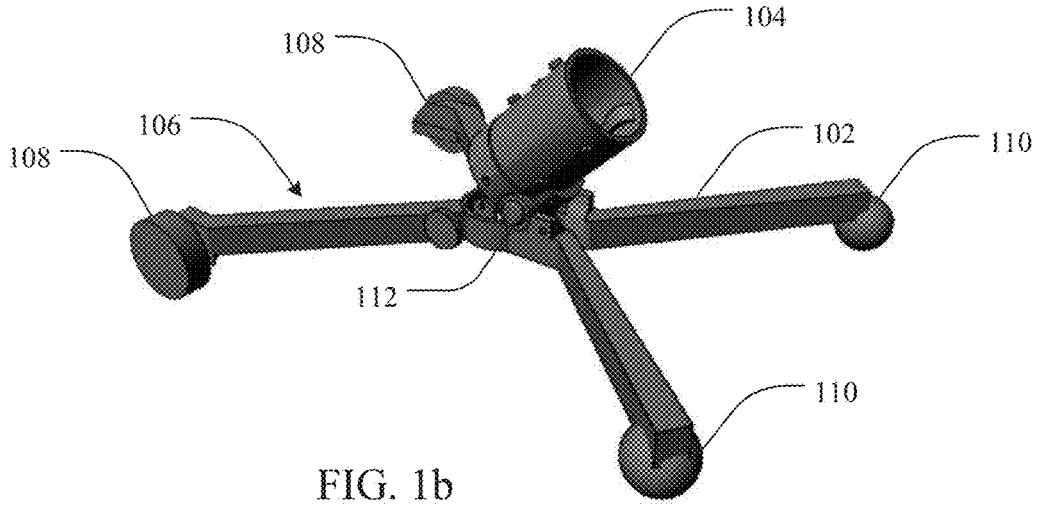
FIG. 1*b* is a perspective view of a device according to one aspect of the present disclosure.
Figure 1C:
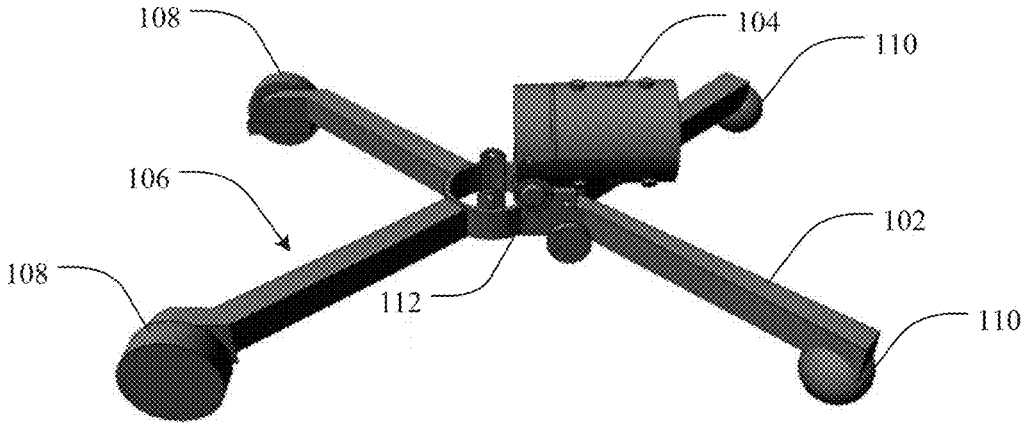
FIG. 1*c* is a perspective view of a device according to one aspect of the present disclosure.

In one non-limiting aspect, a decorative tree stand device can include a support base and a tree support pivotally coupled to an upwardly facing surface of the support base. The tree support is adapted to receive and support a decorative tree in a display or vertical position and to selectively pivot from the vertical position to a non-vertical position, or in other words, to recline or to otherwise drop into a storage position. One non-limiting example of such a tree stand is shown in FIGS. 1*a-c,* including the support base 102 and the tree support 104 coupled to the upwardly facing surface 106 of the support base 102. The support base can include any type of structure capable of supporting a decorative tree in both a vertical and non-vertical position. In some aspects, as in FIGS. 1*a-c,* for example, the support base can include leg members extending out from a central or common location. In other aspects, the support base can include a solid structure such as a flat plate or disc, or an intermediate combination of a flat plate and leg members. Thus, the support base can include a structure having a variety of shapes and sizes, such as conical, pyramidal, trapezoidal, cylindrical, elliptical, rectangular, square, polygonal, or any other suitable shape, in both 2 dimensions and 3 dimensions. In one aspect, the base member can have a core structure with solid structure, a plurality of leg members, or a combination thereof. Additionally, the support base can be made from any useful material including, without limitation, metals, polymers, ceramics, woods, and the like, including combinations thereof. In some cases, the base member can also include a reservoir for storing water, soil, any other suitable material, or a combination thereof.

The support base can additionally be described in terms of being horizontal or horizontally-oriented. As with the term "vertical," for the present purposes the term "horizontal" is intended to be relative to a horizontal support surface, such as a floor. Thus, a horizontally-oriented structure is one that is precisely horizontal with respect to a supporting surface, as well as at reasonable approximations of horizontal as would be understood in the art. Thus, "horizontal" can be understood in the context of the position in which the tree stand is being used to display a decorative tree. Furthermore, substantially horizontal with respect to the base member is intended to be understood as the position in which a bottom plane of the base member is substantially parallel to the ground or other supporting surface.

The support base can also include one or more wheels, castors, or other rolling devices, and in some aspects can have a plurality of wheels. The plurality wheels can be bidirectional, omnidirectional, or combinations thereof In one aspect, as is shown in FIGS. l*a-c,* the support base can have four wheels, two of which are bidirectional 108 and two of which are omnidirectional 110. In another aspect, all of the wheels can be omnidirectional.

As has been described herein, a decorative tree (not shown) can be inserted into the tree support 104, which can, in some cases, can be coupled to or otherwise fastened to the tree support 104. The tree support 104 is pivotally coupled 112 to the support base 102. FIG. 1*a* shows the tree support 104 in the display or vertical position. FIGS. 1*b-c* show the tree support 104 in non-vertical positions.

Figure 2:
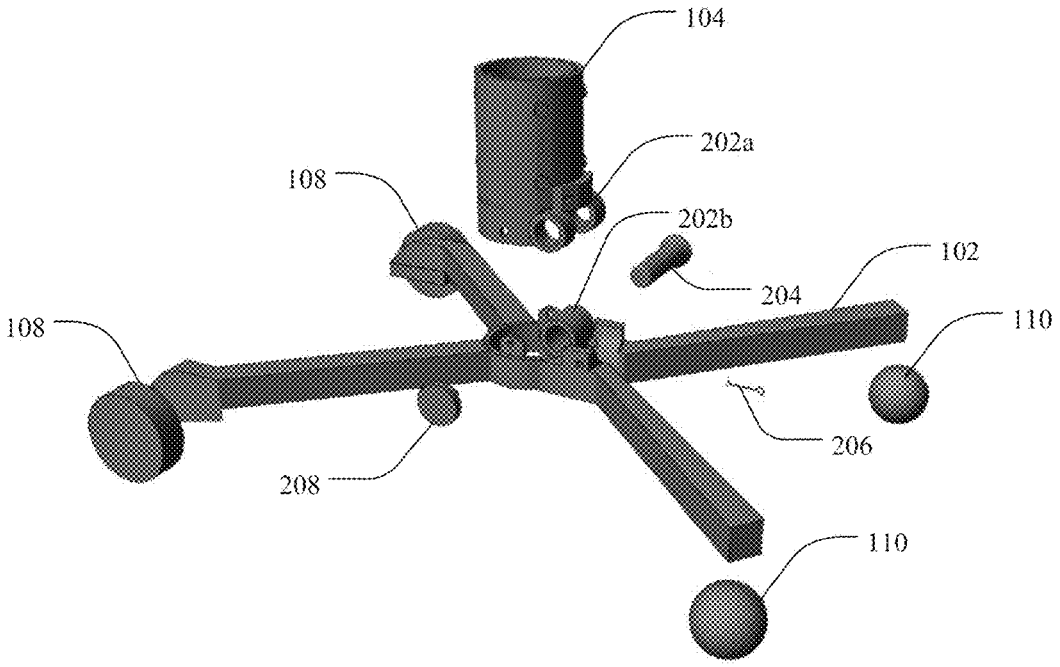
FIG. 2 is a perspective view of a device according to one aspect of the present disclosure.
Figure 3A:
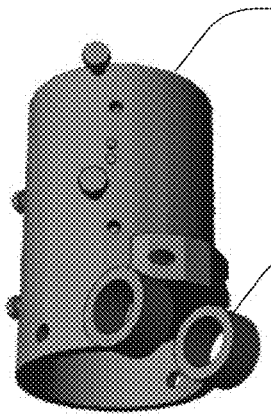
FIG. 3*a* is a perspective view of a device according to one aspect of the present disclosure.
Figure 3B:
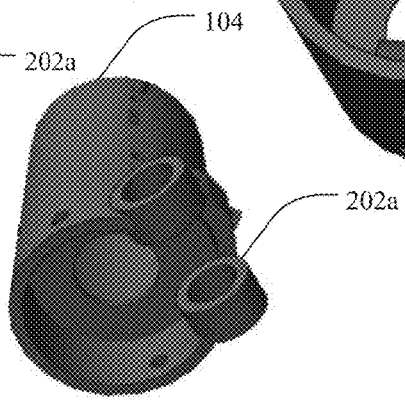
FIG. 3*b* is a perspective view of a device according to one aspect of the present disclosure.
Figure 3C:
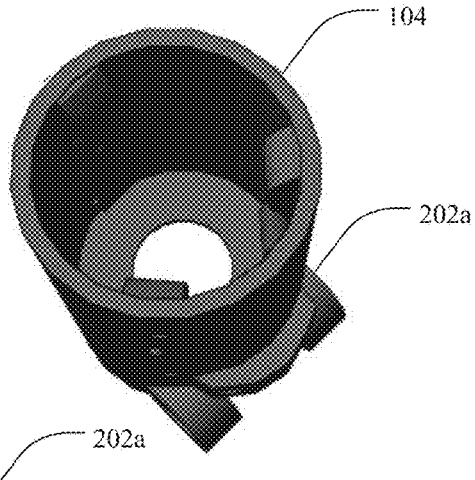
FIG. 3*c* is a perspective view of a device according to one aspect of the present disclosure.
Figure 3D:
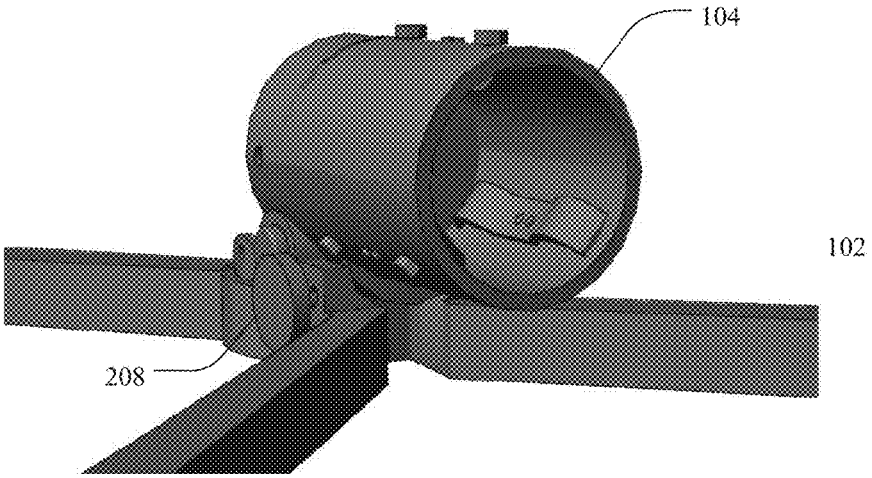
FIG. 3*d* is a perspective view of a device according to one aspect of the present disclosure.

The tree support can be coupled to the support base by any structure or mechanism that allows a connection that is sufficiently stable to support the decorative tree, but that also allows the tree support to be pivoted to a non-vertical position while the tree is attached thereto. In one aspect, for example, the tree support can be coupled to the support base using a hinge, hinge-like joint, or other suitable attaching mechanism that allows the tree support to pivot, swivel, rotate, or similarly move relative to the support base while the support base remains stationary. One non-limiting example is shown in FIG. 2, where the tree support 104 is coupled to the support base 102 by a hinge 202*a-b.* A hinge pin 204 is shown that can slide through joined halves of the hinge 202*a-b* to facilitate the pivotal connection. A cotter pin 206 can be inserted into the hinge pin 204 to secure the hinge 202*a-b.* Furthermore, a locking screw 208 is shown that secures the tree support 104 in a vertical position by engaging both the support base 102 and the tree support 104. FIGS. 3*a-d* show additional views of the tree support 104. It is noted that elements having the same number descriptors between separate figures denote the same or similar elements.

Figure 4A:
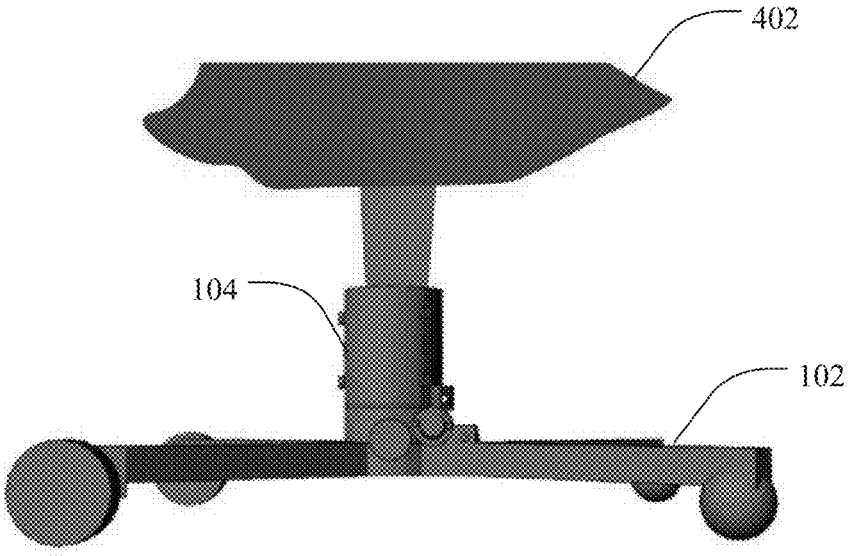
FIG. 4*a* is a perspective view of a device according to one aspect of the present disclosure.
Figure 4B:
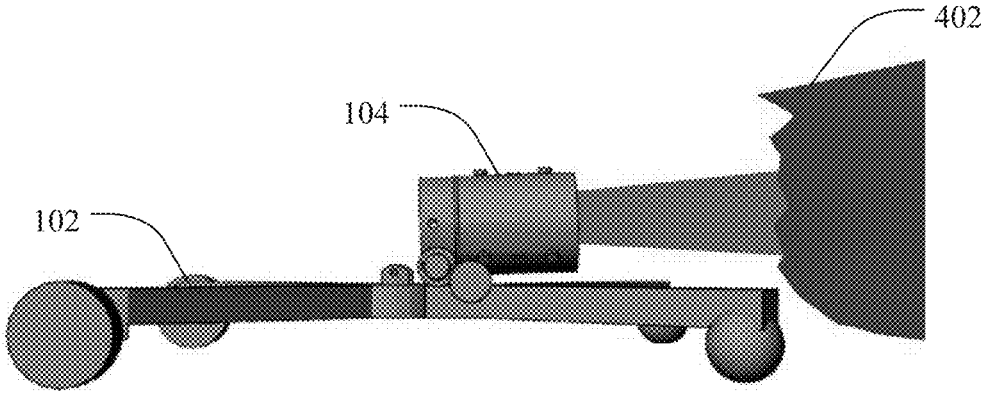
FIG. 4*b* is a perspective view of a device according to one aspect of the present disclosure.

Accordingly, the tree support can be selectively pivoted from a vertical position to a non-vertical position, or in other words, from a display position to a storage position. For example, FIGS. 4*a-b* show a decorative tree 402 coupled to a tree support 104 that is pivotally coupled to a support base 102. FIG. 4*a* shows the decorative tree 402 in the vertical or display position, and FIG. 4*b* shows the decorative tree 402 in a non-vertical or storage position. In some aspects, a storage position can be any position that renders the tree to be more easily transported and storable as compared to the display position. In other aspects, an angle between the tree trunk in the display position and the tree trunk in a storage position (measured from the pivot point) can be from 10° to 90°, or from 25° to 90°, or from 45° to 90°, or from 75° to 90°, or 90°, or any angle between 10° and 90°. FIG. 4*b* shows a non-vertical position of 90°.

Thus, when moving a tree in and out of a doorway, for example, the tree support can be pivoted into a non-vertical position to lower or to lay the tree down into a position to facilitate transport through the doorway. As another example, when loading the tree into a vehicle, trailer, or other transportation device, the tree support can be similarly pivoted to more easily allow the loading and/or transport of the decorative tree. Additionally, this can provide added stability to the tree during transportation by allowing the bottom of the support base to rest flat on a supporting surface, while simultaneously allowing the tree to lie in a substantially horizontal position that can reduce damage due to wind or airborne objects. The support base can also reduce movement of the tree during transportation, thus minimizing damage to the tree and other items being transported.

Figure 5A:
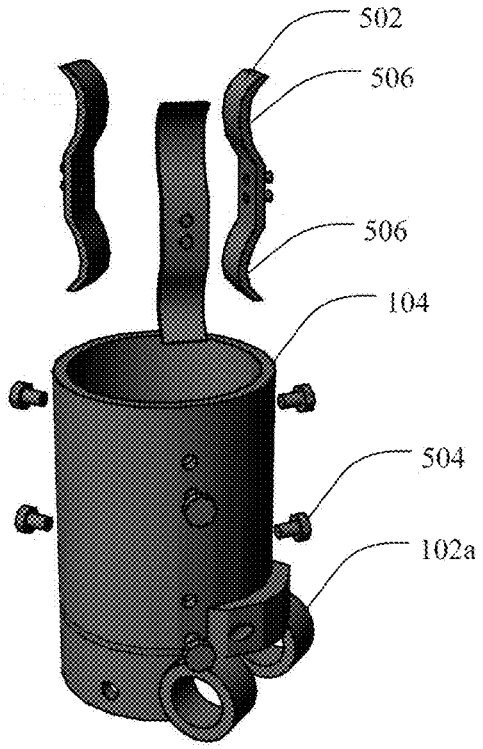
FIG. 5*a* is a perspective view of a device according to one aspect of the present disclosure.
Figure 5B:
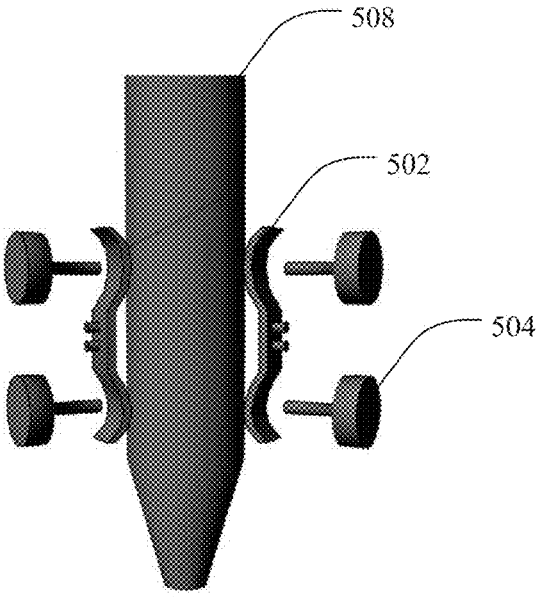
FIG. 5*b* is a perspective view of a device according to one aspect of the present disclosure.

The tree support can hold, support, and/or secure the trunk of the decorative tree in any suitable manner. In one aspect, for example, the tree support can include a plurality of screws that extend through the tree support to directly contact the trunk of the decorative tree. In another aspect, as is shown in FIG. 5*a-b,* a plurality of tension brackets 502 can be coupled to an interior surface of the tree support 104. Screws 504 inserted through the tree support 104 contact the tension brackets 502, causing the tension brackets 502 to flex toward the trunk 508 of the decorative tree to secure and steady the decorative tree. In the case of FIGS. 5*a-b,* tension brackets 502 having two flexing regions 506 are shown, which provide added stability to the trunk 508 of the decorative tree to resist turning and tipping. Other suitable methods of securing the trunk of a tree within a tree stand that are known in the art can also be employed.

Figure 6A:
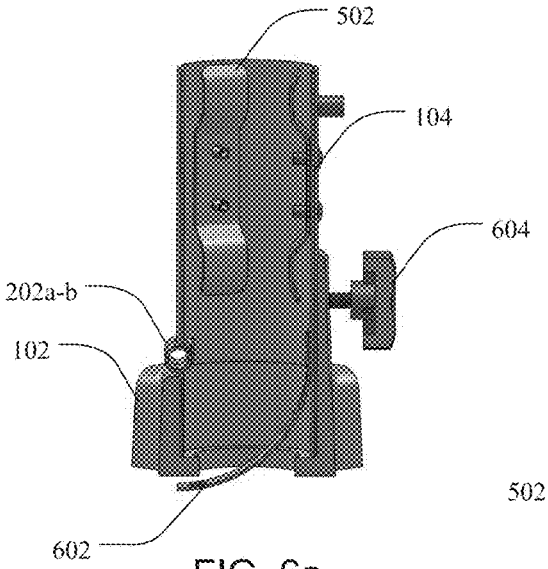
FIG. 6*a* is a cross-section view of a device according to one aspect of the present disclosure.
Figure 6B:
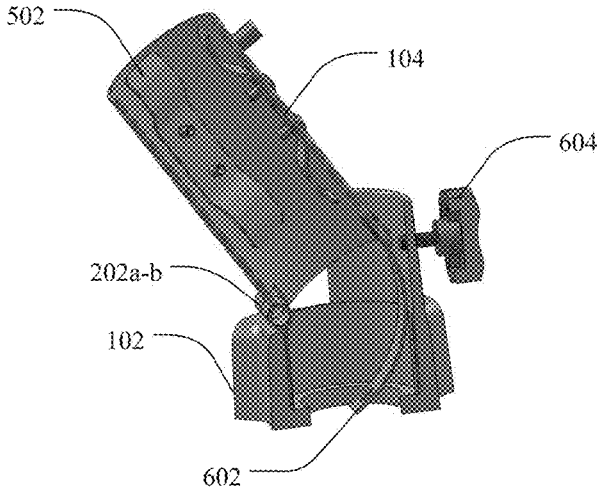
FIG. 6*b* is a cross-section view of a device according to one aspect of the present disclosure.
Figure 6C:
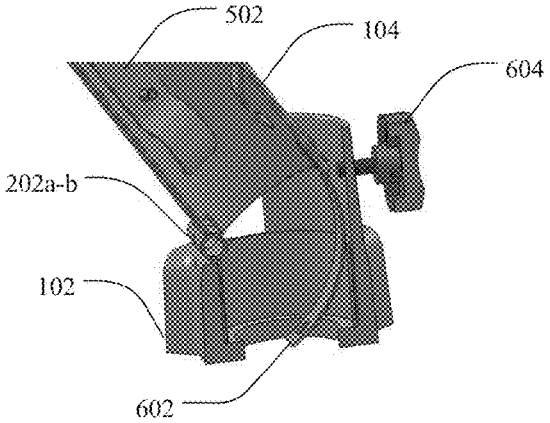
FIG. 6*c* is a cross-section view of a device according to one aspect of the present disclosure.

A decorative tree stand device can also include a resistance member coupled to the tree support, wherein the resistance member is adapted to increase in resistance as the tree support is pivoted away from the vertical position. This can allow a user to more controllably recline the tree and more easily incline the tree back to a vertical position. The resistance member can be incorporated into a hinge or hinge-like joint as a torsion spring or other suitable structure. The resistance member can also be connected to the support base and the tree support in a manner that causes the resistance member to stretch as the tree support pivots away from the vertical position, such as by an extension spring, elastomeric band, or other suitable resistance member. In one aspect, as is shown in FIGS. 6*a-c,* the resistance member can include an arcuate member 602 attached to the tree support 104 that extends downwardly within the support base 102, such that when the tree support 104 is pivoted away from the vertical position, the arcuate member 602 resistively contacts the support base 102 to provide a more controlled declination of the tree support 104. FIG. 6*a* shows the tree support 104 in the vertical position where the arcuate resistance member 602 is coupled to the tree support 104 and that extends downward within the support base 102. FIGS. 6*b-c* shows cross-sectional views of the embodiment of FIG. 6*a,* where the tree support 104 is pivoted to a non-vertical position and the arcuate resistance member 602 has engaged the support base 102 to provide resistance to further pivotal motion.

Additionally, the arcuate member 602 can include one or more openings or slots adapted to receive a securing member 604 to secure the tree support 104 in one or more non-vertical positions depending on the number and positioning of the slots. A securing member can also be used in designs other than those including an arcuate member to secure the tree support. The securing member can be made of metal, polymer, wood, or other suitable material, including combinations thereof. In some aspects, the securing member can be a knob or pin that is spring-loaded, screws into place, snaps into place, clips into place, or otherwise engages the arcuate member or other resistance member. In some aspects, the securing member can include a cantilever or cantilever-like mechanism that is adapted be adjustable by a foot of a person handling the decorative tree. One end of the cantilever can pivot outwardly from the support member to allow it to selectively recline or incline as the other end of the cantilever pivots inwardly towards the support base. The cantilever can then be pivoted in the opposite direction to re-engage the tree support and secure it at a desired non-vertical position. In some aspects the cantilever mechanism can also be spring-loaded.

Figure 7:
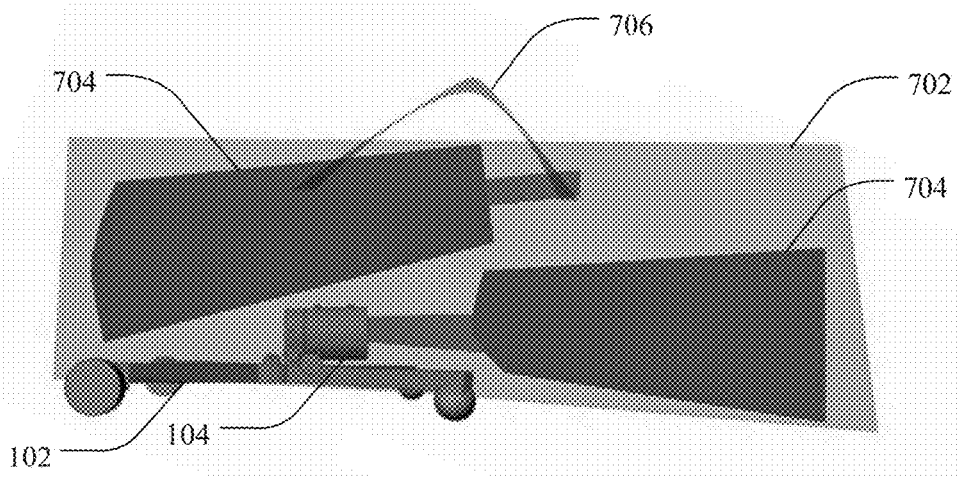
FIG. 7 is a perspective view of a device according to one aspect of the present disclosure.

In some aspects, the decorative tree stand can also include an enclosure, such as, for example, a storage bag 702, as shown in FIG. 7. The storage bag can be made from any suitable material, including the non-limiting examples of canvass, nylon, cloth, linen, fabric, and the like. The storage bag 702 can be large enough to contain the entire decorative tree as assembled, or the decorative tree 704 in separated component parts. The storage bag 702 can be permanently attached to the support base 102 or other part of the decorative tree stand, or the bag can be removably attached to the support base 102. In one aspect, the storage bag can be coupled to the support base in a manner whereby the storage bag can function as a tree skirt, or that can be hidden under a tree skirt. In another aspect, the attached storage bag can be folded or otherwise placed underneath the tree stand or in a lower storage compartment within the support base. The storage bag 702 can also include one or more handles 706 to facilitate movement of the decorative tree 704.

In another aspect, a decorative tree support system is provided. Such a system can include a decorative tree stand device as previously described, and a decorative tree coupled to the tree support of the decorative tree stand device. The decorative tree can be a holiday tree, such as a Christmas tree, or any other decorative tree for weddings, parties, routine business or home decor, or any other occasion. The decorative tree can be a single piece or it can disassemble into a plurality of pieces. The tree can include lights and associated wiring or circuitry, ornaments, ribbons, other suitable features, and combinations thereof. In one aspect, the decorative tree can be angled from 25 degrees to 90 degrees from the vertical position. In another aspect, the system can include a tree storage bag coupled to the support base, wherein at least a portion of the decorative tree is contained in the tree storage bag.

In another aspect, a method of displaying and storing a decorative tree is provided. Such a method can include coupling a trunk of a decorative tree to the tree support of the decorative tree stand as has been described herein, and displaying the decorative tree in the vertical position. The method can further include selectively pivoting the tree support and the decorative tree into a non-vertical position and moving the decorative tree stand into a storage location. In another aspect, the method can also include enclosing at least a portion of the decorative tree within a storage container coupled to the support base of the decorative tree stand.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A decorative tree stand device, comprising:

a support base;

a tree support adapted to receive and support a decorative tree in a vertical position; and a pivot joint coupled to an upwardly facing surface of the support base and to a lateral side of a bottom end of the tree support, and having a pivot axis positioned at the lateral side passing through the pivot joint to selectively pivot the tree support from the vertical position to a non-vertical position around the pivot axis.

2. The device of claim 1, wherein the non-vertical position is at an angle of from 25 degrees to 90 degrees from the vertical position.

3. The device of claim 1, wherein the non-vertical position is at an angle of from 45 degrees to 90 degrees from the vertical position.

4. The device of claim 1, wherein the non-vertical position is at an angle of from 75 degrees to 90 degrees from the vertical position.

5. The device of claim 1, further comprising a resistance member coupled to the tree support and adapted to increase in resistance as the tree support is pivoted away from the vertical position.

6. The device of claim 1, further comprising a position lock adapted to secure the tree support in at least one non-vertical position.

7. The device of claim 1, further comprising a tree storage bag coupled to the support base and configured to contain at least a portion of a tree when coupled to the tree support.

8. The device of claim 1, further comprising a plurality of wheels coupled to the support base and operable to facilitate movement of decorative tree stand device from a first location to a second location.

9. A decorative tree support system, comprising:

a decorative tree stand device as in claim 1; and a decorative tree coupled to the tree support of the decorative tree stand device.

10. The system of claim 9, wherein the decorative tree is a holiday tree.

11. The system of claim 9, wherein the decorative tree is a Christmas tree.

12. The system of claim 9, wherein the decorative tree is angled from 25 degrees to 90 degrees from the vertical position.

13. The system of claim 9, further comprising a tree storage bag coupled to the support base, wherein at least a portion of the decorative tree is contained in the tree storage bag.

14. A method of displaying and storing a decorative tree, comprising:

coupling a trunk of a decorative tree to the tree support of the decorative tree stand of claim 1;

displaying the decorative tree in the vertical position;

selectively pivoting the tree support and the decorative tree into a non-vertical position; and moving the decorative tree stand into a storage location.

15. The method of claim 14, further comprising enclosing at least a portion of the decorative tree within a storage container coupled to the support base of the decorative tree stand.

16. The method of claim 15, wherein the storage container is a storage bag.

17. The method of claim 14, wherein the non-vertical position is at an angle of from 25 degrees to 90 degrees from the vertical position.

18. The method of claim 14, wherein the non-vertical position is at an angle of from 45 degrees to 90 degrees from the vertical position.

19. The method of claim 14, wherein the non-vertical position is at an angle of from 75 degrees to 90 degrees from the vertical position.

20. The device of claim 1, further comprising a resistance member extending downwards within the support base.

* * * * *